US008584926B2

(12) United States Patent
Bull

(10) Patent No.: US 8,584,926 B2
(45) Date of Patent: Nov. 19, 2013

(54) CARTON WITH INCREASED WIDTH ACCESS OPENING

(75) Inventor: Nicholas R. Bull, Tarrytown, NY (US)

(73) Assignee: Kraft Foods Group Brands LLC, Northfield, IL (US)

( * ) Notice: Subject to any disclaimer, the term of this patent is extended or adjusted under 35 U.S.C. 154(b) by 495 days.

(21) Appl. No.: 12/347,331

(22) Filed: Dec. 31, 2008

(65) Prior Publication Data

US 2010/0163609 A1 Jul. 1, 2010

(51) Int. Cl.
*B65D 5/00* (2006.01)
*B65D 77/02* (2006.01)
*B23P 19/00* (2006.01)

(52) U.S. Cl.
USPC ..... 229/109; 206/739

(58) Field of Classification Search
USPC ..... 229/109, 122.1, 221, 223, 227; 206/739, 750, 755, 757, 45.21, 738; 222/93; 221/100, 101, 105; 426/389, 426/114
See application file for complete search history.

(56) References Cited

U.S. PATENT DOCUMENTS

| | | | | |
|---|---|---|---|---|
| 2,347,422 | A * | 4/1944 | Loth | 229/109 |
| 2,565,188 | A | 8/1951 | Welshenbach | |
| 3,019,920 | A | 2/1962 | Hillenbrand et al. | |
| 3,467,298 | A | 9/1969 | Wysocki | |
| 3,738,564 | A | 6/1973 | Persson | |
| 4,119,266 | A | 10/1978 | Dempster | |
| 4,134,531 | A | 1/1979 | Martinez et al. | |
| 4,260,100 | A | 4/1981 | Hoffman | |
| 4,382,510 | A * | 5/1983 | Gaffney | 206/396 |
| 4,386,729 | A | 6/1983 | Schmidt | |
| 4,441,649 | A | 4/1984 | Nederveld | |
| 4,792,084 | A | 12/1988 | Dreeszen | |
| 4,793,546 | A * | 12/1988 | Nunn | 229/109 |
| 4,899,927 | A | 2/1990 | Straub et al. | |
| 5,624,368 | A | 4/1997 | Cromwell | |
| 5,628,450 | A | 5/1997 | Cromwell et al. | |
| 5,752,648 | A | 5/1998 | Quaintance | |
| 6,059,179 | A | 5/2000 | Giampapa | |
| 6,220,508 | B1 | 4/2001 | Wisser | |
| 6,221,415 | B1 * | 4/2001 | Walters | 426/389 |
| 6,264,034 | B1 | 7/2001 | Bacques et al. | |
| 6,394,742 | B1 | 5/2002 | Buscema | |
| 6,405,921 | B1 | 6/2002 | Cochrane | |

(Continued)

FOREIGN PATENT DOCUMENTS

| | | |
|---|---|---|
| EP | 0255410 | 2/1988 |
| EP | 0587132 | 3/1994 |
| WO | 03006321 | 1/2003 |
| WO | 2005063584 | 7/2005 |

*Primary Examiner* — Gary Elkins
*Assistant Examiner* — Christopher Demeree
(74) *Attorney, Agent, or Firm* — Fitch, Even, Tabin & Flannery LLP

(57) ABSTRACT

An eight-sided, octagonal carton having an increased width opening and strength as compared to a four-sided, rectangular carton, and providing for improved removal of a food product stored within the carton. The octagonal carton has a top panel, a bottom panel, and an octagonal sidewall comprising a pair of longitudinal segments and a pair of transverse end segments. The end segments further comprise a pair of individual panels that can fold at an angle to provide three sides along each end segment; two angled sides and one side perpendicular to the longitudinal segments. To gain access to the interior of the carton, only one of the panels needs to be opened creating an access opening through which the food product is extracted.

11 Claims, 4 Drawing Sheets

(56) References Cited

U.S. PATENT DOCUMENTS

| | | | |
|---|---|---|---|
| 6,598,785 | B2 | 7/2003 | Quaintance |
| 6,688,514 | B2 | 2/2004 | Evans et al. |
| 6,749,107 | B2 | 6/2004 | Quaintance |
| 6,783,058 | B2 | 8/2004 | Quaintance |
| 7,006,302 | B2 | 2/2006 | Takahashi et al. |
| 7,090,115 | B2 | 8/2006 | Pierce |
| 7,234,628 | B2 | 6/2007 | Remaks et al. |
| 7,278,565 | B2 | 10/2007 | West |
| 7,350,670 | B2 | 4/2008 | Steeves et al. |
| 2003/0004044 | A1 | 1/2003 | Kelley |
| 2003/0019920 | A1 | 1/2003 | Quaintance |
| 2003/0141354 | A1 | 7/2003 | Quaintance |
| 2003/0192945 | A1 | 10/2003 | Quaintance |
| 2005/0040216 | A1 | 2/2005 | Quaintance |
| 2005/0274778 | A1 | 12/2005 | Rubyan et al. |
| 2006/0180642 | A1 | 8/2006 | Zacher et al. |
| 2007/0063002 | A1 | 3/2007 | Zacher et al. |
| 2007/0228119 | A1 | 10/2007 | Barner |

* cited by examiner

CARTON WITH INCREASED WIDTH ACCESS OPENING

FIELD

This application generally relates to cartons for containing items, and, in particular, to cartons for containing items where an end of the carton has two flaps configured to permit one or both of the two flaps to be opened for removal of an item from an interior of the carton.

BACKGROUND

One type of carton for containing items, and in particular a plurality of individually packaged food items, is generally rectangular. The carton has a top, bottom and four sides, as illustrated in FIGS. 7 and 8. Two of the sides are formed from two separate panels, so that one of the panels can be opened while the other remains closed. Depending upon the size of the packaged food items, they can be withdrawn through the opening formed between the closed panel and the sidewall adjacent the opened panel, while the closed panel can somewhat restrict unintentional removal of the others of the packaged food items. However, a disadvantage of this type of carton is that the width of the opening is limited to being about half the width of the carton.

SUMMARY

A carton is provided having a top, bottom and sidewall, where the sidewall has eight sides. The sidewall can comprise a pair of longitudinal segments and a pair of transverse or end segments, where the end segments can each further comprise a pair of panels. Each panel can have an outer segment, relatively perpendicular to the longitudinal segment, and an intermediate segment that extends at an angle between the outer segment and the adjacent longitudinal segment. Each panel can be movable from a closed position to an open position, providing an access opening to an interior of the carton when in the open position for extracting an item, such as a food product, from therein.

The access opening provided in the eight-sided carton is greater than if the end panels were provided entirely perpendicular relative to the longitudinal panels. For example, a length of the access opening provided is larger than a length of an access opening in a four-sided, or rectangular, carton. Additionally, the length of the access opening in the eight-sided carton is larger than about half a width of the carton. This larger access opening allows for easier removal through the opening of the food product stored therein, especially when one must insert their hand or partially insert their hand in order to retrieve the product therein.

Furthermore, the shape of the carton, i.e., having angled end segments that can form an eight-sided or octagonal sidewall, can also provide for an increased strength of the carton. This increased strength can further decrease crushing of the carton and protect the products packaged therein, and can permit use of lower strength materials, such as lower strength corrugated cardboard.

Yet another advantage of the eight-sided carton is that improved ventilation can be achieved when multiple such cartons are stacked together. For prior cartons of the type illustrated in FIGS. 7 and 8, when stacked together, such as on a pallet for shipping, there is little to no space remaining between the cartons. In contrast, spaces can be created between the eight-sided cartons, and in particular, the intermediate segments of the panels of the end segments of the sidewalls of adjacent cartons. Thus, when these cartons have been recently loaded with hot-packed food items, these spaces can provide for improved ventilation and thus faster cooling of a stack of cartons.

DETAILED DESCRIPTION OF THE DRAWINGS

A carton with an increased width access opening is illustrated in FIGS. 1-6. The assembled carton has a top panel and a bottom panel with a sidewall extending therebetween, the sidewall having a generally octagonal shape. The sidewall comprises a pair of longitudinal segments and a pair of end segments, where the end segments comprise a pair of panels. Each panel of the end segments further has an outer segment perpendicular to the longitudinal segment and an intermediate segment extending at an angle between the longitudinal segment and the outer segment. At least one of the pair of end segments can be movable from a closed position to an open position to allow for removal of a plurality of individual food items. Upon moving the at least one pair of end segments to the open position an access opening to the interior of the carton can be created, where the access opening can be sized greater than half a width of the carton.

Figure 1:
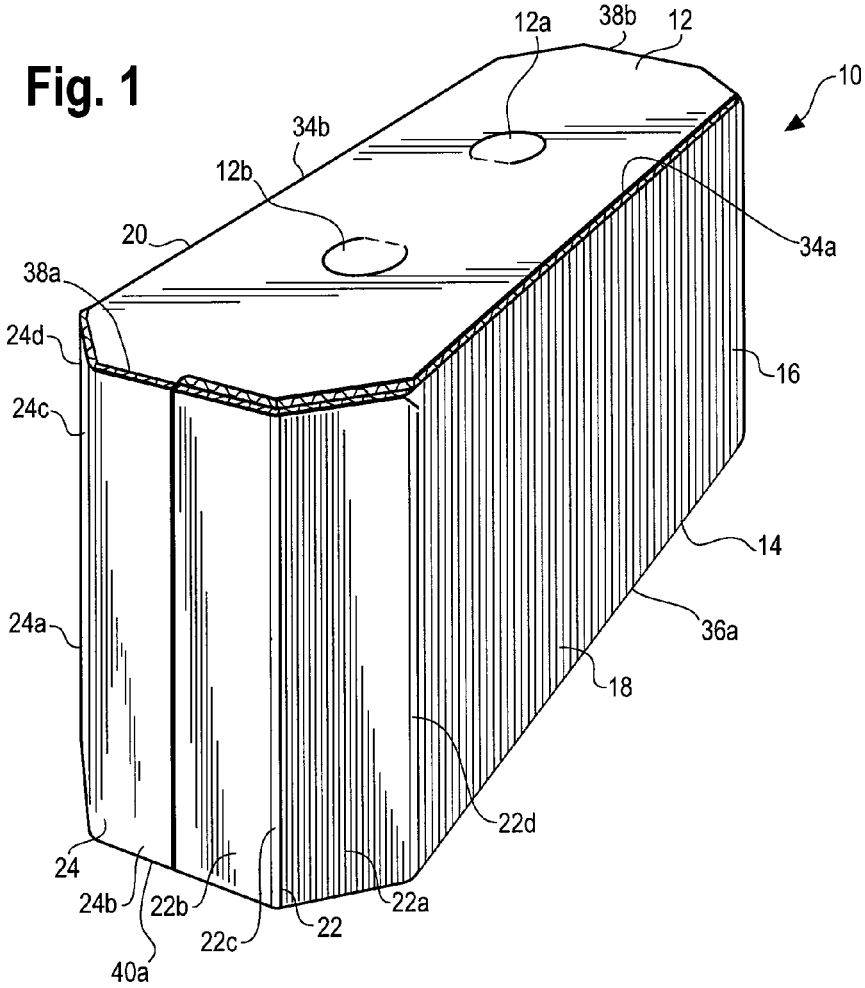
FIG. 1 is a perspective view showing an octagonal carton configured to have an increased width access opening and showing one of the ends of the carton in a closed configuration covering the access opening.

Turning to FIG. 1, the assembled and closed carton 10 is shown having a top panel 12 and a bottom panel 14, with a sidewall 16 extending between the top panel 12 and the bottom panel 14 to form an interior of the carton 10. The top panel 12 and the bottom panel 14 each have a pair of longitudinal edge portions 34*a* and 34*b*, 36*a* and 36*b*, respectively, and a pair of transverse edge portions 38*a* and 38*b*, 40*a* and 40*b*, respectively.

The sidewall 16 can further comprise a pair of longitudinal segments 18 and 20 extending between the longitudinal edge portions 34*a* and 34*b* and 36*a* and 36*b* of the top and bottom panels 12 and 14 and a pair of end segments extending between the transverse edge portions 38*a* and 38*b* and 40*a* and 40*b* of the top and bottom panels 12 and 14. Each end segment can comprise a pair of panels 22 and 24 or 26 and 28, where each panel can have an edge attached to an edge portion of one of the sidewall longitudinal segments 18 or 20. For instance, a first end segment can comprise a pair of panels 22 and 24. In the aspect shown in FIG. 1, a first panel 22 can have an edge attached to an edge portion of the sidewall longitudinal segment 18 and a second panel 24 attached to the other sidewall longitudinal segment 20. Likewise, a second end segment, positioned at an end opposite the first, can comprise a pair of panels 26 and 28. A third panel 26 can have an edge attached to the edge portion of the longitudinal segment 18 and a fourth panel 28 attached to the edge portion of the longitudinal segment 20.

Each panel 22, 24, 26, and 28 can further comprise an outer segment generally perpendicular to the longitudinal segments when cooperating with the other of the pair of end panels to enclose the interior and an intermediate segment extending at an angle between the edge portion of the adjacent longitudinal segment and the adjacent outer segment.

Figure 2:
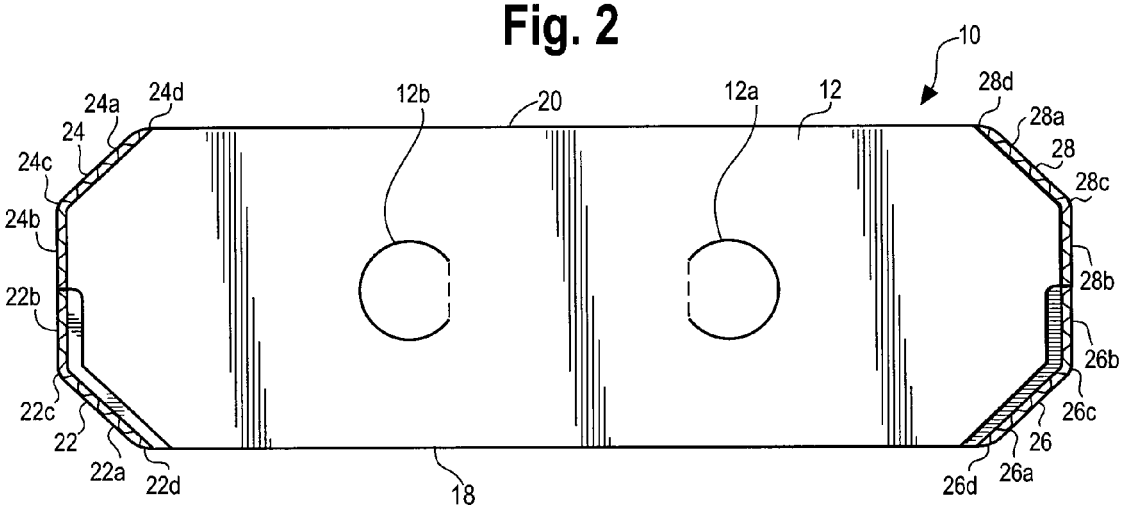
FIG. 2 is a top plan view of the carton of FIG. 1.

The panels 22, 24, 26 and 28 can be located at transverse ends of the carton 10, each transverse end containing a pair of end panels 22 and 24 or 26 and 28. Each pair of end panels 22 and 24 or 26 and 28 can have the intermediate segment angled and connected to the adjacent longitudinal panel along one edge and connected to the outer segment along the opposite edge of the intermediate segment. For example, in the aspect shown in FIG. 1, the first panel 22 can have an outer segment 22*b* and an intermediate segment 22*a*, which is connected to the edge portion of longitudinal segment 18 and extends between the longitudinal segment 18 and the outer segment 22*b* at an angle when in the closed position. Both can further contain fold lines to assist in folding the first panel 22 at a slight angle. In this aspect, the outer segment 22*b* can be folded along a fold line 22*c* and the intermediate segment 22*a* can be folded along a fold line 22*d*, as shown in FIG. 2.

Similarly, the second panel 24 can have an outer segment 24*b* and an intermediate segment 24*a*, each also having respective fold lines 24*c* and 24*d*. When both the first panel 22 and the second panel 24 are in a closed and sealed position, the panels 22 and 24 can extend past the edges of the longitudinal segments 18 and 20. The intermediate segments 22*a* and 24*a* can be angled from the carton 10 while the outer segments 22*b* and 24*b* can be positioned generally perpendicular to the longitudinal segments 18 and 20. The free ends of the outer segments 22*b* and 24*b* can further be positioned adjacent one another. Likewise, the third panel 26 and the fourth panel 28 on the opposite transverse end of the carton 10 can be similarly arranged. The third panel 26 also can have an intermediate segment 26*a* with fold line 26*d* and an outer segment 26*b* with a fold line 26*c*. Likewise, the fourth panel 28 can have an intermediate segment 28*a* with adjacent fold line 28*d* and an outer segment 28*b* with adjacent fold line 28*c*. When all of the panels 22, 24, 26 and 28 have been sealed and are all in the closed position, the sidewall 16 can have a generally octagonal shape. In other words, each end segment or transverse end can have three sides, that can protrude out from the edge of the longitudinal segments 18 and 20.

Figure 3:
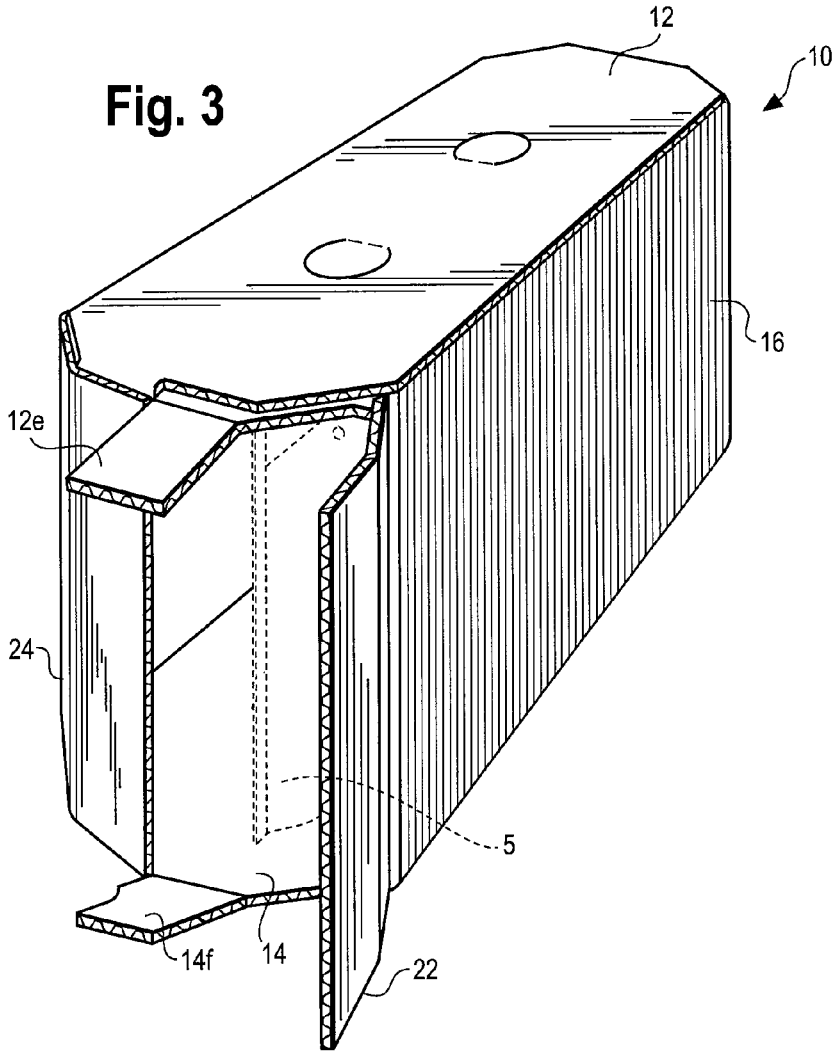
FIG. 3 is a perspective view of the carton of FIG. 1 showing one of the ends of the carton in a partially open configuration.
Figure 4:
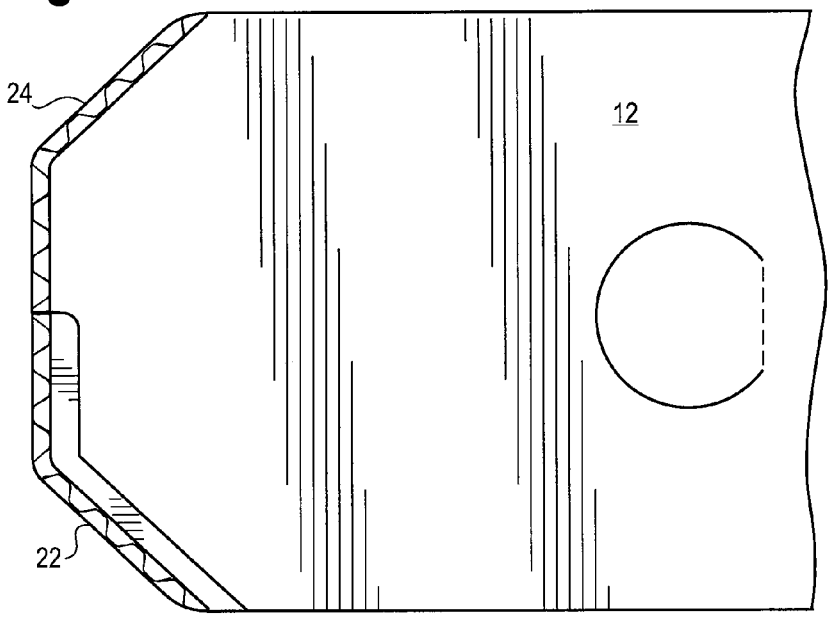
FIG. 4 is an enlarged top plan view of the carton of FIG. 1 showing one of the ends in a closed configuration.
Figure 5:
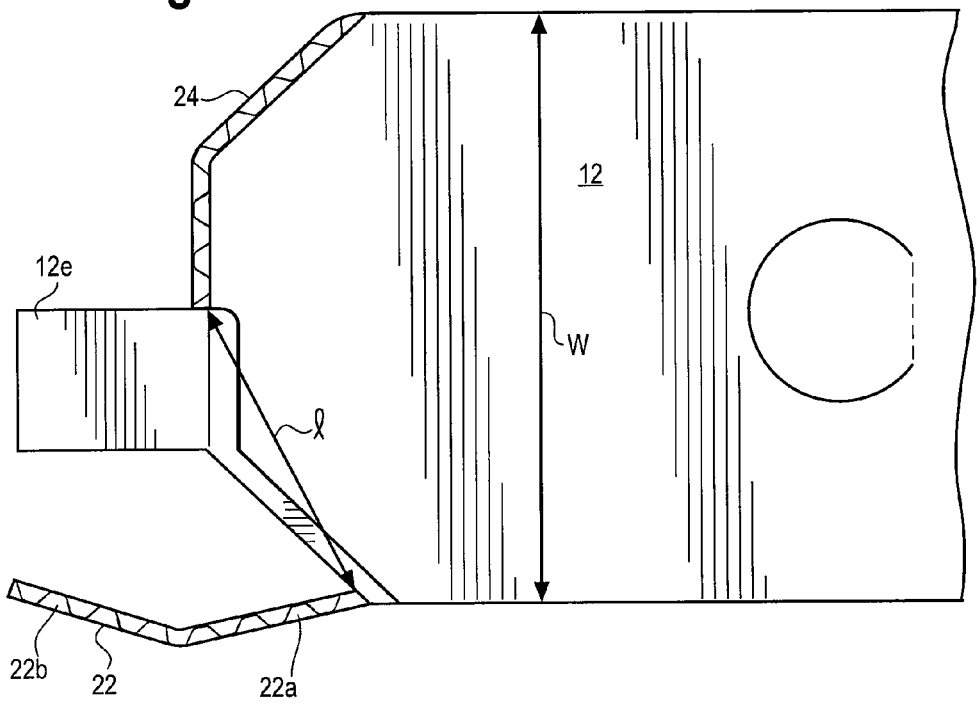
FIG. 5 is an enlarged top plan view of the carton of FIG. 3 showing one of the ends of the carton in a partially open configuration.

Turning to FIGS. 3 and 5, the partially open carton 10 is illustrated. Each of the end segments, and in particular one of its end panels 22, 24, 26, and 28, can each be individually movable from a closed position, as in FIG. 1, to an open position, as in FIG. 3, to permit access to the interior of the carton 10. One of the end panels can be movable relative to the connected longitudinal panel 18 or 20 to create an access opening for the interior of the carton 10. In the aspect shown in FIG. 3, the first end panel 22 can be shifted from its initially closed (and sealed) position to an open position. The remaining end panels 24, 26, and 28 can remain closed. Alternatively, more than one end panel can be opened, although it is not necessary to gain adequate access to the interior of the carton 10. Upon opening the first end panel 22, the outer segment 22*b* and intermediate segment 22*a* are both shifted along their respective fold lines 22*c* and 22*d* to allow the entire first end panel 22 to pivot open, much like a door along a hinge, to form the access opening. As the end panel 22 is opened, an upper tab 12*e* and a lower tab 14*f* can be exposed. These tabs 12*e* and 14*f* can be used to seal against the end panel 22 to help keep the panel 22 in the closed position. The lower tab 14*f* can be an extension of the bottom panel 14 and the upper tab 12*e* can be an extension of the top panel 12. Upon opening the end panel 22, the seal between the end panel 22, and in particular between an inner or back surface of the outer segment 22*b* and the tabs 12*e* and 14*f*, must first be separated. Once the end panel 22 is opened, the product 5 inside of the carton 10 can be accessed and removed from the interior of the carton 10. Alternatively, any end panel can be opened instead of the first end panel 22.

Additionally, as the first end panel 22 is opened and its respective tabs 12*e* and 14*f* exposed, the second end panel 24 can remain in the closed position, held in place by its respective tabs 30*c* and 14*g*. The tabs 30*c* and 14*g* can remain sealed against the back surface of the second end panel 24 to keep the second end panel 24 in the closed position. The lower tab 14*g* can be an extension of the bottom panel 14 and the upper tab 30*c* can be an extension of the top panel 12, or as in the aspect shown in FIG. 6, an extension of a secondary top panel 30, as will be described in more detail herein. For example, the adjacent upper tabs 12*e* and 30*c* can both initially be provided in a sealed configuration against the back surface of each respective end panel 22 and 24 when in the closed position, yet when one panel is opened, such as the first end panel 22, then its tab 12*e* becomes exposed while the other tab 30*c* remains sealed against the second panel 24, holding the second panel 24 in a closed position. Likewise, with the bottom tabs 14*f* and 14*g*. The third and fourth panels 26 and 28 of the opposite side of the carton 10 can be similarly arranged. In the aspect shown in FIGS. 1-6, the tabs 12*c*, 12*e*, 14*a*, 14*c*, 14*f*, 14*g*, 30*a*, and 30*c* are shown as having generally straight edges (with the exception of the tabs 14*a*, 14*c*, 14*f*, and 14*g*, which can have at least one rounded edge). However, other suitable shapes may be utilized such as all rounded edges, or some other variation thereof having rounded or angled edges or corners.

Turning to FIG. 5, a top view is shown of the carton 10 having the first end panel 22 in an open position. The carton 10 can have a width, W, and the access opening can have a length, C. The length, t, can be measured along a diagonal from the intersection point of the longitudinal segment 18 and the intermediate segment 22*a* to the edge of the second end panel 24, or the edge of its outer segment 24*b*. The length, l, of the carton 10 shown in FIG. 5 has an access opening that is greater than half the width of the carton, or $l > \frac{1}{2} W$.

Figure 7:
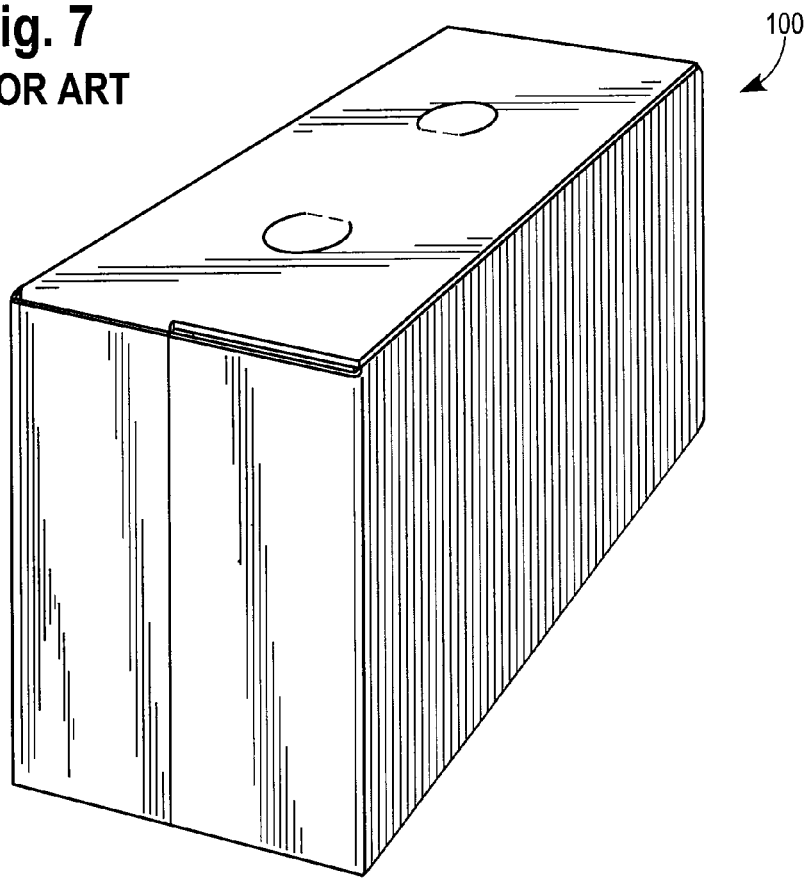
Fig. 7 PRIOR ART
FIG. 7 is perspective view of a rectangular prior art carton.
Figure 8:
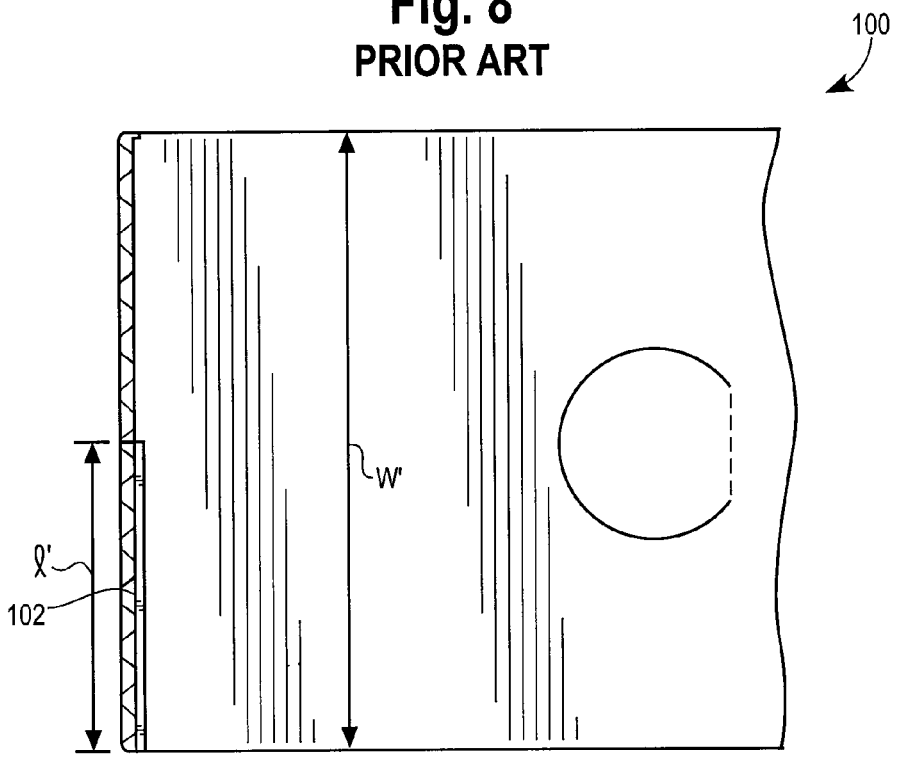
Fig. 8 PRIOR ART
FIG. 8 is a top plan view showing an end of the prior art carton of FIG. 7 in a closed configuration.

The access opening of the carton 10 can be greater than an access opening of a prior carton 100, as shown in FIGS. 7 and 8. For example, the carton 100 in FIG. 8 can have a width, W', and can have a length of an end panel 102 approximately equal to l', so that when opened the carton 10 provides an access opening for the carton 100 having a length approximately equal to l', which also generally corresponds to the length of the end panel 102. The length of the access opening in the prior carton 100 is approximately equal to the length, l', of the end panel 102. In some instances, when both pairs of end panels are in the closed position and sealed, as in FIG. 7, a slight gap (not shown) may exist between the adjacent end panels. Therefore, the actual length of the end panel 102 may be slightly smaller than the actual length of the access opening of the prior carton 100. However, for the sake of discussion herein, it will be understood that the length of the end panel 102 is equivalent to the length of the access opening; in other words, the length, l', can equal the length of the end panel 102 plus the length of the gap, if any, between the pair of adjacent end panels when closed. Thus, where it is stated that $l > l'$, it should be understood that l is greater than the length of the end panel 102 plus the length of the gap, if one is present. The length, l', is also generally equivalent to ½ W'; where it is understood that ½ W' is generally equivalent to the length of the end panel wall 102 plus the length of the gap, if any.

On the other hand, the access opening of the carton 10 is greater than the access opening of the prior carton 100, when the two cartons 10 and 100 have equivalent widths (i.e., W=W'), because the arrangement of the end panels 22, 24, 26 and 28 provides for a larger opening to the interior of the carton. Therefore, l can be greater than l' (when W is approximately equal to W') and the design of the carton 10 provides for a larger access opening that results in an easier removal area when withdrawing the products 5 from the interior of the carton 10. Additionally, the food products 5 can each have a width that is less than the length of the access opening that allows for easier extraction of the product than if it were to be removed through the opening in the prior carton 100.

Figure 6:
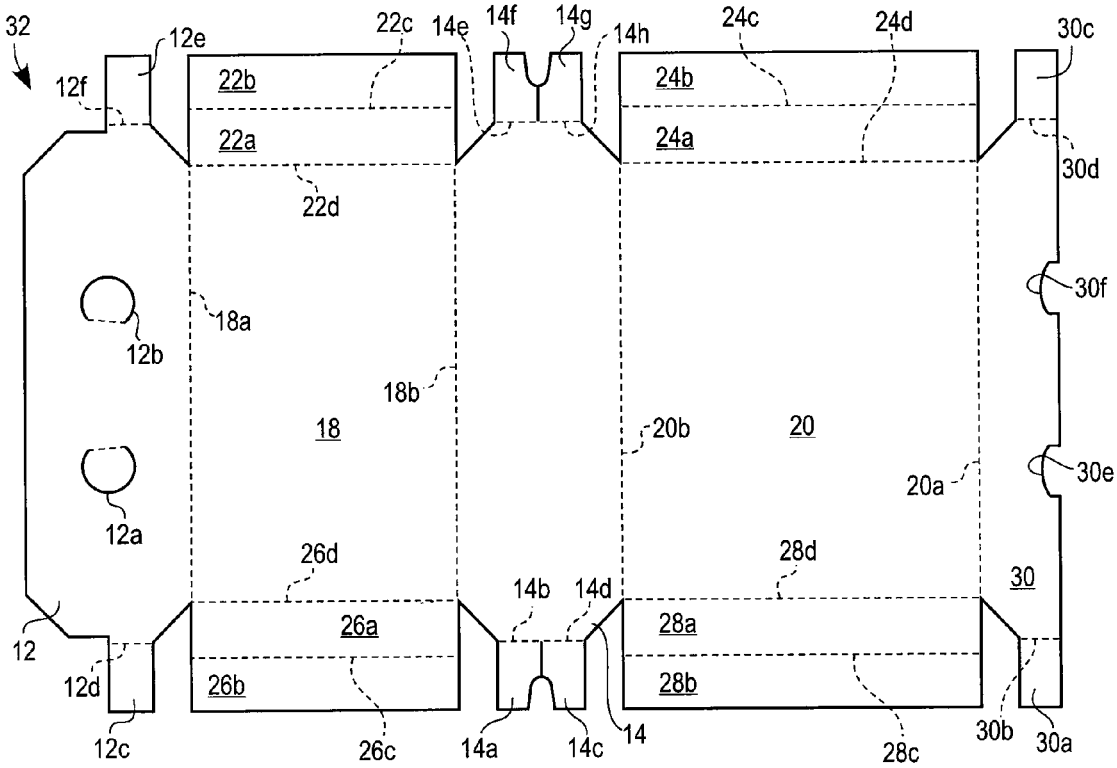
FIG. 6 is a top plan view of a blank that can be assembled to form the carton of FIG. 1.

Turning to FIG. 6, a blank 32 is provided for assembly into the carton 10 shown in FIG. 1. The dashed lines of the blank 32 can indicate fold lines, which are areas of the blank 32 which can fold to form the carton 10. The fold lines may optionally be pre-scored or otherwise weakened. The bottom panel 14 can comprise one contiguous piece with the longitudinal segments 18 and 20 of the sidewall 16 folded upwards from the bottom panel 14 along fold lines 18*b* and 20*b*, respectively, to form a portion of the upstanding sidewall 16, and in particular the planar portion of the sidewall 16. The longitudinal segments 18 and 20 can be folded relatively perpendicularly to the bottom panel 14. The top portion of the carton 10 can be made up of at least two pieces of the blank 32; the visible top panel 12 and a secondary top panel 30, which can be positioned beneath the top panel 12 and can further be sealed against a bottom or interior surface of the top panel 12 to provide for a closed carton 10. The top panel 12 can also be folded along its fold line 18*a*, such that it can be positioned at approximately a right angle to the adjacent longitudinal segment 18 or relatively perpendicular to it. Likewise, the secondary top panel 30 can also be folded along its fold line 20*a*, thus resulting in a relatively perpendicular position to its adjacent longitudinal segment 20. As the secondary panel 30 is folded along its fold line 20*a* and positioned underneath the top panel 12, its half circle portions 30*e* and 30*f* can be matched up with a part of circular portions 12*a* and 12*b* of the top panel 12.

Furthermore, the top panel 12 can have a pair of tabs 12*c* and 12*e* that can be folded down from the top panel 12 at relatively perpendicular positions along respective fold lines 12*d* and 12*f* to seal against the back surface of adjacent end panels. For instance, top panel tab 12*c* can seal against the back surface of end panel 26 and top panel tab 12*e* can seal against the back surface of end panel 22. Likewise, the secondary top panel 30 can also have tabs 30*a* and 30*c*, which can be folded at relatively perpendicular angles to the secondary top panel 30 and can seal against adjacent end panels 28 and 24, respectively.

Similarly, the bottom panel 14 also can have two pairs of tabs, one set on each end that can be folded upward at a relatively perpendicular angle to the bottom panel 14 and can be sealed to the back surface of adjacent end panel portions. In one aspect, a first side of the bottom panel 14 can have two tabs 14*f* and 14*g* with respective fold lines 14*e* and 14*h*. These two tabs 14*f* and 14*g* can be folded upward at a relatively perpendicular position to the bottom panel 14. These tabs 14*f* and 14*g* can then be sealed to an adjacent end panel; tab 14*f* can seal to a back surface of first panel 22 and tab 14*g* can seal to a back surface of the second panel 24. Similarly, a second side of the bottom panel 14 can have two tabs 14*a* and 14*c* with respective fold lines 14*b* and 14*d*. These two tabs 14*a* and 14*c* can also be folded upward at relatively a perpendicular angle to the bottom panel 14 and sealed to adjacent end panels. Tab 14*a* can be sealed to a back surface of the third panel 26 and tab 14*d* can be sealed to a back surface of the fourth panel 28. Preferably, each tab 14*a*, 14*d*, 14*f* and 14*g* can be sealed to the back surface of the outer segment of its adjacent panel.

The carton 10 can also contain optional features, such as a handhold or fingerhold feature 12*a* and 12*b* along the top panel 12 of the carton 10 for easier transporting of the carton 10. These handholds 12*a* and 12*b* can be any suitable shape and size and can comprise a completely cut out section, a partially perforated section that can be partially freed or punched out to create a small opening for someone's fingers, or variations thereof. In the aspect shown in FIGS. 1-6, a pair of fingerholds 12*a* and 12*b* are shown having a semi-circular shape. At least one side of each fingerhold can remain attached to the top panel 12 initially while the remainder of the fingerholds 12*a* and 12*b* can be unattached. This provides for later insertion of at least one finger to punch out or separate the unattached end of the fingerhold 12*a* and 12*b* from the top panel 12 and to allow a finger to support part of the top panel 12 during transportation.

The carton 10 can be made of typical carton materials known in the art, such as corrugated board and the like. The carton 10 can be used to store and transport various types of food products 5. The food products 5 can typically be packaged before packing into the carton 10, such as packaging the food product in a rounded and/or flexible package. Some food products 5 may comprise cheese, meats, other snack foods, any packaged food product in rounded bottles or cans, packaged beverages (such as hot-packed, foil pouches) and the like.

The dimensions of the carton 10 can vary depending upon the size of the food product 5 therein, and can be sized at least large enough to allow the food product 5 to be easily extracted through the access opening. Regardless of the carton 10 dimensions, the length of the access opening should be at least greater than half the width of the carton 10, i.e., l>½ W. In one aspect, the width, W, of the carton can be about 3.5 inches, with a height of about 5.8 inches. A length of the longitudinal segments 18 and 20 can be about 9⅜ inches with the access opening about 2 inches, however, any other dimensions can be used that provide l>½ W.

A method of removing the food products 5, or a plurality of individual items, can be provided. To remove the food product 5, first at least one of the end panels of the end segment must be opened to gain access to the interior of the carton 10. The end panel can be opened by moving the end panel from a closed position to an open position, to provide an access opening that permits access to the interior of the carton 10. As stated above, the access opening can have a length greater than half a width of the carton 10. Once the at least one end panel is opened, then at least one of the plurality of food products 5 therein can be removed from the interior of the carton 10 through the access opening.

Where only one end panel 22 is opened, the adjacent end panel 24 can remain in the closed position. The closed end panel 24 can remain in the closed position by maintaining its sealed configuration with its respective tabs 30*c* and 14*g*, one tab 30*c* depending from the (secondary) top panel 30 of the carton 10 and one tab 14*g* upstanding from the bottom panel 14 of the carton 10. Prior to opening the one pair of end panels 22, the end panel 22 can also be sealed against a back surface of its respective tabs 12*e* and 14*f*, which tabs are the other pairs of the adjacent end panel 24. To open the one pair of the end panels 22, the end panel 22 can be separated from its respective tabs 12*e* and 14*f*, where one of the pairs of tabs 12*e* can be depending from the top panel 12 and one of the pair of tabs 14*f* can be upstanding from the bottom panel 14, to provide the access opening.

EXAMPLES

Example 1

The compression strength of a control, rectangular carton, i.e., having four planar sidewalls, and the compression strength of an octagonal carton as disclosed herein, i.e., having an eight-sided sidewall, were measured and compared to one another. The compression strength of the cartons was measured using a standard compression test of fiberboard shipping containers, which is designated as test method TAPPI T804 (Technical Association of the Pulp and Paper Industry). This method is used for measuring the ability of corrugated or solid fiber shipping containers to resist external compressive forces. The method may be applied in a number of ways. For quality studies, it is usually desirable to test the empty container, as was tested in the following examples herein. The compression strength was determined by the value at which the carton or corrugated board failed, i.e., was compressible, and two samples of each was tested. The cartons tested both had the same width and relative height of the carton. The test results indicated that the rectangular carton had a lower compression strength than the octagonal carton. The rectangular carton had a compression strength value of about 332 pounds and about 401 pounds compared to the compression strength of the octagonal carton, which was about 512 pounds and about 611 pounds.

Thus, the rectangular carton had an average compression strength value of about 367 pounds and the octagonal carton had an average compression strength value of about 562 pounds, or about a 53% increase in strength over the rectangular carton. Therefore, the octagonal carton was shown to have an increased strength as compared to the prior rectangular carton.

Example 2

The same test method as described in Example 1 (TAPPI T804) was utilized to test another batch of multiple control cartons and octagonal cartons. The cartons were all tested at about 70° F. and at a relative humidity of about 50%. Fifteen control cartons were tested and those compression strength results are shown in Table 1, as well as the average compression strength of all fifteen control cartons.

TABLE 1

| Control Cartons Compression Testing Results | |
|---|---|
| Control Sample No. | Compression Test Results (pounds) |
| 1 | 390 |
| 2 | 414 |
| 3 | 410 |
| 4 | 388 |
| 5 | 398 |
| 6 | 374 |
| 7 | 358 |
| 8 | 352 |
| 9 | 317 |
| 10 | 354 |
| 11 | 411 |

TABLE 1-continued

| Control Cartons Compression Testing Results | |
|---|---|
| Control Sample No. | Compression Test Results (pounds) |
| 12 | 334 |
| 13 | 414 |
| 14 | 367 |
| 15 | 371 |
| Average Compression Strength | 376.8 |

Six octagonal cartons were tested and those compression strength results are shown in Table 2, as well as the average compression strength of all six cartons.

TABLE 2

| Octagonal Cartons Compression Testing Results | |
|---|---|
| Octagonal Carton Sample No. | Compression Test Results (pounds) |
| 1 | 545 |
| 2 | 534 |
| 3 | 533 |
| 4 | 571 |
| 5 | 507 |
| 6 | 491 |
| Average Compression Strength | 530.17 |

The average compression strength value of the control carton was about 376.8 pounds and the average compression strength value of the octagonal carton was about 530.17 pounds. The octagonal carton had about a 40% increase in strength over the control carton. Therefore, the octagonal carton was shown to have an increased strength as compared to the prior rectangular cartons used as control samples.

From the foregoing, it will be appreciated a carton with increased width access opening, and method of removing an item therefrom, is provided such that numerous modifications and variations could be made thereto by those skilled in the art without departing from the scope of the carton and method set forth in the claims. Therefore, the disclosure is not limited to the aspects and embodiments described hereinabove, or to any particular embodiments. Various modifications to the carton and the method of removal could be made which can result in substantially the same carton and method of removal.

What is claimed is:

1. A carton for containing a plurality of individual food items for removal, the carton comprising:

a top panel and a bottom panel each having a pair of longitudinal edge portions and a pair of shorter transverse edge portions; and a sidewall extending between the top and bottom panels to form an interior of the carton, the sidewall having a pair of spaced longitudinal segments fixed relative to each other extending between the longitudinal edge portions of the top and bottom panels to join the top and bottom panels, and the sidewall having a pair of end segments extending between each transverse edge portion of the top and bottom panels, each of the end segments having a pair of panels each attached to an edge portion of one of the sidewall longitudinal segments and having an outer segment generally perpendicular to the longitudinal segments when in a closed position and an intermediate segment extending at an angle between the edge portion of the longitudinal segment of the sidewall and the outer segment, the end segments each being individually movable from a closed position to an open position to permit access to the interior of the carton, and an end segment in the open position creates an access opening that has a width greater than half a width of the carton.

2. The carton according to claim 1, wherein a width of the individual food items is less than the width of the access opening such that the items can be removed through the access opening.

3. The carton according to claim 1, wherein the sidewall longitudinal segments together with the end segments provide an octagonal top panel and an octagonal bottom panel.

4. The carton according to claim 3, wherein the carton has at least a 40% increase in strength compared to a carton having a rectangular top panel and a rectangular bottom panel.

5. The carton according to claim 1, wherein the individual food item is a packaged beverage product.

6. The carton according to claim 1, wherein the end segments are movable by pivoting about the edge portion of one of the sidewall longitudinal segments.

7. The carton according to claim 1, wherein the pair of longitudinal segments are fixed relative to each other.

8. The carton according to claim 1, wherein the spaced longitudinal segments are parallel to each other.

9. A carton comprising a top, bottom and sidewall defining an interior of the carton, the top and bottom being octagonal, having a pair of spaced longitudinal panels fixed relative to each other and a pair of transverse ends each having three sides, each of the transverse ends being defined by a pair of end panels each end panel having angled segments connected to the longitudinal panels along one edge and an outward segment along an opposite edge, the outward segment positioned to be generally perpendicular to the longitudinal panels when cooperating with the other of the pair of end panels by positioning a free end of the outward segment adjacent a free end of the other outward segment to enclose the interior, one of the pair of end panels being movable relative to the connected longitudinal panel to create an access opening for the interior of the carton, the access opening having a width greater than if the one of the end panels was entirely perpendicular relative to the longitudinal panels.

10. The carton according to claim 9, wherein the carton has at least a 40% increase in strength compared to a carton having a rectangular top and a rectangular bottom.

11. The carton according to claim 9, wherein a width of the individual food items is less than the width of the access opening such that the items can be removed through the access opening.

* * * * *